United States Patent [19]

Siebenhofer et al.

[11] 4,197,035

[45] Apr. 8, 1980

[54] SHIELD-CARRYING ROOF SUPPORT UNIT

[75] Inventors: Gottfried Siebenhofer, Vienna; Heinrich Sussenbeck, Zeltweg, both of Austria

[73] Assignee: Vereinigte Osterreichische Eisen- und Stahlwerke - Alpine Montan Aktiengesellschaft, Vienna, Austria

[21] Appl. No.: 958,684

[22] Filed: Nov. 8, 1978

[30] Foreign Application Priority Data

Nov. 14, 1977 [AT] Austria ..... 8126/77

[51] Int. Cl.[2] ..... E21D 15/44

[52] U.S. Cl. ..... 405/296

[58] Field of Search ..... 405/291-302; 299/31, 33; 248/357; 91/170 MP

[56] References Cited

U.S. PATENT DOCUMENTS

| | | | |
|---|---|---|---|
| 3,915,500 | 10/1975 | Schlusener et al. | 405/296 |
| 4,020,640 | 5/1977 | Sigott et al. | 405/296 X |
| 4,056,941 | 11/1977 | Watermann | 405/296 |
| 4,077,223 | 3/1978 | Koppers et al. | 405/300 X |

*Primary Examiner*—Dennis L. Taylor

*Attorney, Agent, or Firm*—Cushman, Darby & Cushman

[57] ABSTRACT

It is an object of the invention to provide an improved shield-carrying roof support unit which has a linkage for adjusting the elevation of the cap while the pivotal connection between the cap and the shield is constrained to move substantially at right angles to the base frame. The provision of auxiliary links having pivotal connections at properly selected points results in a linkage which has a precisely defined configuration and avoids an overloading of the pivotal connections such as could occur in known shield-carrying roof support units of the same kind.

6 Claims, 5 Drawing Figures

SHIELD-CARRYING ROOF SUPPORT UNIT

This invention relates to a shield-carrying roof support unit comprising a base frame, a shield, which is linked to the base frame, a cap, which is pivoted to the shield, and at least one prop, which acts between the base frame, on the one hand, and the shield or cap, on the other hand. Such shield-carrying roof support units are used mainly in rock which is very brittle so that rock may fall from the roof. The shield-carrying roof support is required to afford optimum protection against such falling rock. The shield-carrying roof support unit must be adjustable in height. Where the shield and cap are connected to the base frame by the conventional linkage, the pivotal connection between the cap and the shield describes during a vertical adjustment of the cap a curve that is determined by the linkage. As a result, the distance between the forward end of the cap and the winning face varies in dependence on the adjusted height on the shield-carrying roof support unit. Obviously, the forward end of the cap can protrude only as far as to the winning face in any adjusted elevation. As a result, there will be a larger or smaller distance between the forward end of the cap and the winning face when the unit has been adjusted to different heights. In that region the roof is not supported and may cave in or pieces of rock may fall down. In order to avoid this, various measures have already been disclosed which may be adopted to avoid a large distance between the forward end of the cap and the winning face. For instance, it is known to mount the shield and the prop or props on a carriage, which is slidable on the base frame at right angles to the winning face so that the forward end of the cap can be moved close to the winning face, regardless of the adjusted height of the unit, if the carriage has been shifted to a proper position. It is also known to provide for an adjustment of the pivotal connection between the shield and the base frame in such a manner that the cap can be arranged at any desired distance from the winning face when the unit has been adjusted to different heights. In that connection it is also known to connect the shield to the base frame by a link which is pivotally movable and can be fixed in position. It is also known to provide means for pivotally connecting the shield to the base frame at different points, as desired. These measures permit of arranging the forward end of the cap close to the winning face, regardless of the adjusted elevation of the shield, and also permit of avoiding an increasing distance between the forward end of the cap and the winning face as the elevation of the shield increases, as is the case with the conventional linkages. These known arrangements thus permit of avoiding a caving in of a roof or a falling of rock between the forward end of the cap and the winning face but the structure required to accomplish this is complicated and expensive and must be adjusted by the operators. Such complicated structures are liable to be deranged and their control requires a relatively high labor expenditure. Besides, the safety which may be afforded by said structures depends on the proper manual control thereof.

It is also known to connect the shield to the base frame by means of two links or two pairs of links in an arrangement in which the lengths of the links or pairs of links and the distances between their pivotal connections are situated so that the pivotal connection between the cap and the shield is constrained to move approximately at right angles to the base frame. In the known arrangements of that kind the prop does not act directly on the shield but on a rockerlever, which is pivoted to the cap and to the shield and which determines the angular position of the cap relative to the shield. For this reason the pivotal connection between the rocker lever and the shield must be shifted so that the cap is moved to an approximately horizontal position when the shield assumes different angular positions. Such a rocker lever constitutes an additional member and the pivotal connections in such an arrangement are highly loaded because the rocker lever includes a very small acute angle with the cap. Besides, the rocker lever, the cap and the shield constitute a linkage and because the prop is pivoted to the rocker lever and the cap is pivoted to the links, said linkage is statically rather indeterminate so that the shield-carrying roof support unit may collapse. In that connection it has also been suggested to connect the pivotal connection between the rocker lever and the shields by a hydraulic linkage to a link or a pair of links. But this cannot eliminate the static indeterminateness and the undesired high load on the pivotal connection between the cap and said intermediate rocker.

Specifically, the invention relates to a shield-carrying roof support unit in which the shield is connected to the base frame by two links or two pairs of links, which are spaced different distances apart from the rear end of the shield-carrying roof support unit, the pivotal connections between the links or pairs of links and the base frame are approximately on the same level, the rear link or pair of links which is or are shorter than the forward link or pair of links, the distance between the pivotal connections between the links or pairs of links and the shield is smaller than the distance between the pivotal connections between the links or pairs of links and the base frame, and the lengths of the links or pairs of links and the distances between the pivotal connections thereof are selected so that the pivotal connection between the cap and the shield is constrained to move approximately at right angles to the base frame. It is an object of the invention to eliminate the disadvantage of such an arrangement. The invention resides essentially in that the prop or props engages or engage the shield or cap close to the pivotal connection between the cap and the shield, the cap is provided with at least one depending arm near the pivotal connection between the cap and the shield, at least one auxiliary link is pivoted to the free end of said arm, and said auxiliary link is pivoted at its other end to one of the links or pairs of links which connects or connect the shield to the base frame. Because the auxiliary link is pivoted at one end to the depending arm of the cap and at its other end to one of the links or pairs of links which connect the shield to the base frame, the cap is supported by that link or pair of links so that the pivotal connection between the shield and cap is considerably relieved and, above all, the stability of the shield-carrying roof support unit in the height to which it has been adjusted has been greatly increased. The link or pair of links, the shield, the auxiliary links, and the depending arm constitute a four-bar linkage, which ensures a high stability. If the depending arm were provided on the shield rather than on the cap, that four-bar linkage would provide for a positive constraint and a perfect static determinateness. Because the pivotal movement of the cap relative to the shield is restricted by the engagement of the cap with the roof, a similar stability is afforded by the arrangement according to the invention, in which the depending arm is provided on the cap.

In a preferred embodiment of the invention, the cap protrudes in known manner toward the winning face beyond the pivotal connection between the cap and shield. This feature further restricts the pivotal movement of the cap relative to the shield so that the auxiliary link which is connected between the link and the depending arm of the cap greatly increases the stability of the shield-carrying roof support unit regardless of the adjusted height thereof.

If the auxiliary link is rigid, the links can be so arranged that the cap is constrained to move parallel to the base frame regardless of the adjusted height of the shield-carrying roof support unit. Such a desirable arrangement of the links will be obtained within the scope of the invention, e.g., if the distance from the pivotal connection between the auxiliary link and the depending arm to the pivotal connection between the cap and the shield is approximately as large as the distance from the pivotal connection between the auxiliary link and the forward link or pair of links to the pivotal connection of said forward link or pair of links.

In a preferred embodiment of the invention the auxiliary link consists of a hydraulic actuator so that the auxiliary link may be used to impart to the cap a pivotal movement of a few degrees and to increase the contact pressure between the cap and the roof. In that case the provision of the depending arm on the cap increases the stability and substantially relieves the pivotal connection between the cap and the shield but also enables the cap to be set. In accordance with the invention, the other end of the auxiliary link or of the hydraulic actuator which constitutes the auxiliary link is pivoted to the forward link or pair of links. This results in a simpler structure because the forward link or pair of links is nearer to the depending arm of the cap and the space between the forward link or pair of links and the depending arm of the cap can be used to accommodate the auxiliary link or the hydraulic actuator which constitutes said auxiliary link.

In accordance with the invention the prop or props is or are desirably inclined opposite to the link or pairs of links. Such an upward and forward inclination of the props is know per se but within the scope of the present invention affords the advantage that the props also tend to increase the stability of the shield-carrying roof support unit.

An embodiment of the invention will be explained by way of example with reference to the drawing.

FIG. 1 is a side elevation,

FIG. 2 is a top plan view and

Figure 1:
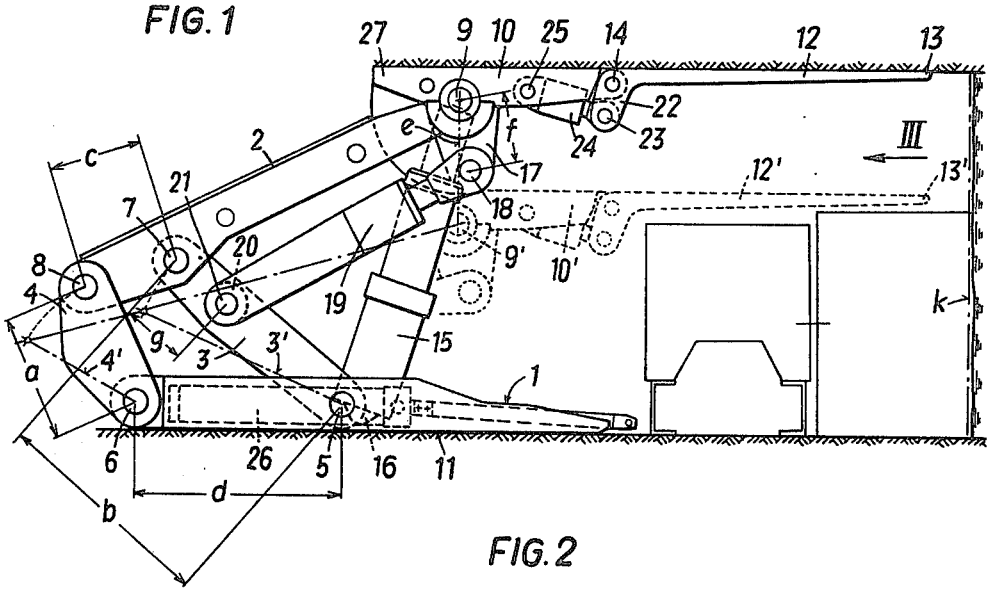
FIGS. 1, 2 and 3 show a shield-carrying roof support unit in a substantially elevated operating position. A lower operating position is shown in dotted lines.
Figure 2:
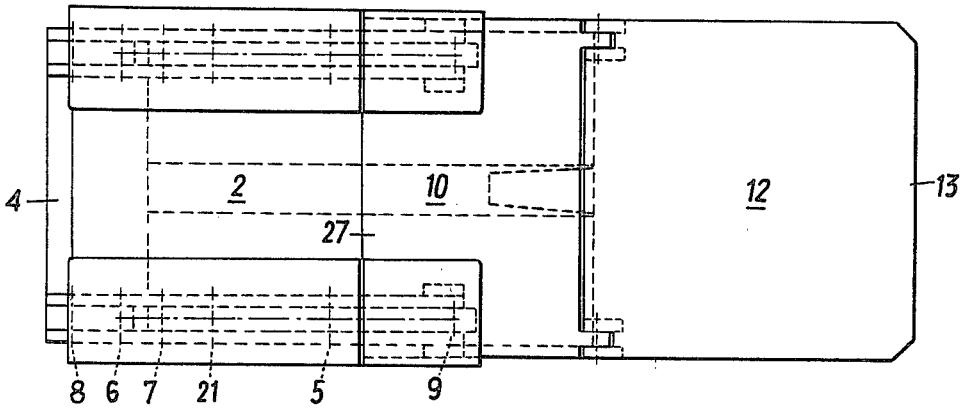
Figure 3:
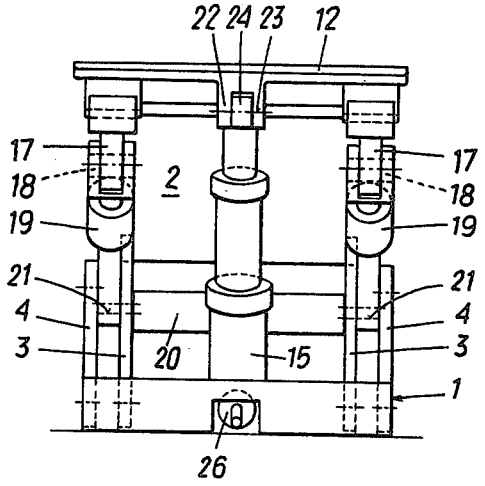

FIG. 3 an elevation taken in the direction of the arrow III in FIG. 1.

Figure 4:
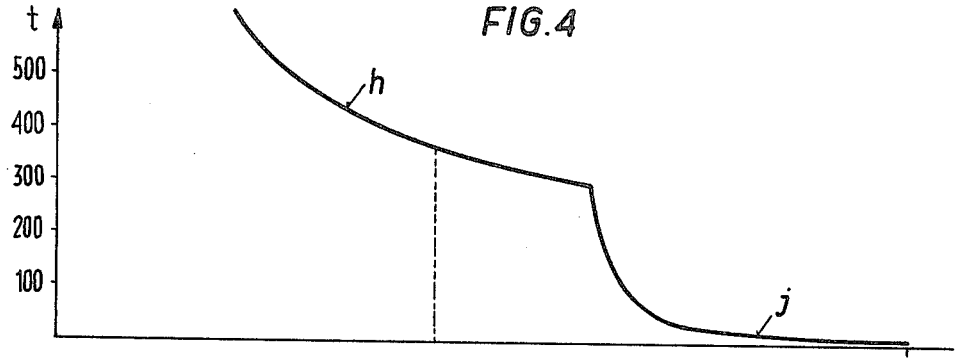

FIG. 4 shows by way of example a diagram in which the load applied is plotted along the shield and cap.

Figure 5:
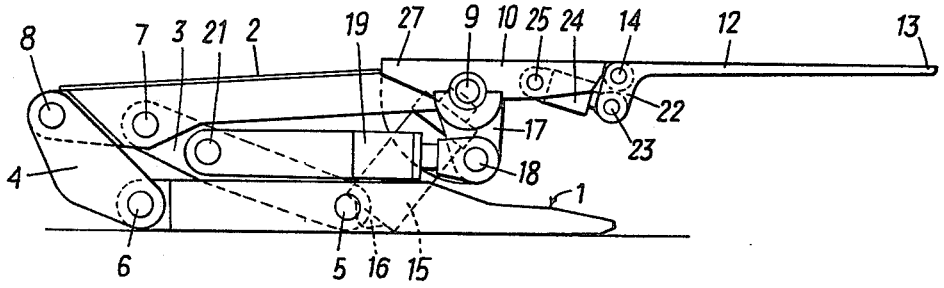

FIG. 5 shows the shield-carrying roof support unit in its lowest position, which may also be the position for transit.

The shield 2 is linked by two pairs of links 3 and 4 to a base frame 1. The pivotal connections 5 and 6 between these pairs of links 3 and 4 and the base frame consist of pins, and lie approximately on the same level. The pivotal connections 7 and 8 between these pairs of links 3 and 4 and the shield 2 consist of pins. A cap 10 is pivotally connected to the shield 2 at 9. A forward end cap 12 is pivotally connected to the cap 10 at 14. The forward end of the forward end cap is designated 13.

The length a of each link 4 is shorter than the length b of each link 3. The length a is about 3/5 of the length b. The distance c between the pivotal connections 7 and 8 is smaller than the distance d between the pivotal connections 5 and 6 and amounts to approximately one-half of the latter distance. This permits of such configuration of the linkage that the pivotal connection 9 between the cap 10 and the shield 2 moves approximately at right angles to the bottom surface 11 of the base frame 1 during the adjustment of the shield-carrying roof support unit to a larger height. Because the floor is normally horizontal and the winning face is normally vertical, that movement of the pivotal connection 9 is parallel to the winning face. The cap 10 is shown in solid lines in its uppermost position. The lowest operating position to be expected is indicated in dotted lines. In that position, the pivotal connection 9 is disposed at 9', the cap 10 is in position 10', the forward end cap 12 in position 12', and the links 3 and 4 are in positions 3' and 4'. During the adjustment of the shield-carrying roof support unit, the pivotal connection 9 is moved along a path indicated by the vertical phantom line so that the forward end 13 of the forward end cap 12 moves parallel to the winning face and remains close to the latter until it has reached position 13'. The winning face is indicated by a phantom link k. In this manner, a large distance between the forward end 13 and the winning face k is avoided throughout the adjustment so that pieces of rock cannot fall down.

The shield-carrying roof support unit is adjusted in height by means of a pair of hydraulic props 15, which can be telescopically extended. Each prop 15 comprises two telescopic cylinders and a piston, which is guided in the inner cylinder, so that each prop 15 can be extended to more than twice its smallest length. The props 15 are pivoted to the base frame 1 at 16 and are pivoted to the forward end of the shield 2 at the pivotal connection 9 between the shield 2 and the cap 10. The props 15 are inclined opposite to the links 3 and 4 so that the force exerted by the props 15 tends to impart an upward pivotal movement to the links 3 and 4.

The cap 10 comprises a depending arm 17, to which an auxiliary link 19 is pivoted at 18. The other end of the auxiliary link 19 is pivoted to the forward pair of links 3 at 21. The end 27 of the cap 10 protrudes rearwardly beyond the pivotal connection 9. As a result, the cap 10 when engaging the roof cannot be pivotally moved relative to the shield 2 and the arm 17 depends from the pivotal connection 9 regardless of the height to which the shield-carrying roof support unit has been adjusted. The shield 2, the arm 17, the link 3 and the auxiliary link 19 thus form a four-bar linkage which constrains the pivotal connection 9 to move in exactly a vertical direction so that the shield-carrying roof support frame is stabilized. The distance f from the pivot 18 of the auxiliary link 19 to the pivotal connection 9 is approximately as large as the distance g from the pivotal connection 21 between the auxiliary link 19 and the link 3 to the pivotal connection 7 between the auxiliary link 3 and the shield 2. If the links are properly arranged, a rigid auxiliary link 19 will suffice to ensure that the cap 10 moves parallel to the winning face and the pivotal connection 9 moves along the vertical line e during an adjustment of the shield-carrying roof support unit in height. In the present embodiment the auxiliary link 19 consists of a hydraulic actuator so that it is possible not only to constrain the cap 10 to move parallel to the winning face but also to set the cap 10 and to force it against the roof, which may be non-parallel to the floor. The auxiliary link is pivoted to the pair of links 3 at 21 by means of a cross-beam 20.

It is apparent from FIG. 1 that the auxiliary link 19 is upwardly inclined so that it assists the action of the props and also takes up part of the load. Because the arm 17 to which the auxiliary link 19 is connected is provided on the cap 10, the auxiliary link 19 forces the cap 10 upwardly so that the pivotal connection 9 is relieved.

The forward end cap 12 is provided with an arm 22 to which a piston-cylinder unit 24 is pivoted at 23. The piston-cylinder unit 24 is supported against the cap 10 at a pivotal connection 25 and can be used to set the forward end cap 12.

A conventional shifting cylinder 26 engages the longwall conveyor.

FIG. 4 is a diagram in which the load is plotted along the shield-carrying supporting frame. The numbers along the ordinate indicate the carrying capacity in metric tons. In the direction of the line h, the carrying capacity decreases as far as to the pivotal connection 14. The carrying capacity of the forward end cap 12 is indicated by line j and decreases as far as to the end 13 of the cap 12.

FIG. 5 shows the shield-carrying roof support unit in its lowermost position, in which the unit can be transported and which may also be assumed during operation when there has been a bursting of rock, i.e., under abnormal conditions. Even in this position of the unit an operator will be sheltered in such an abnormal case. The room under the cap 10 still has a height of 400 to 600 mm so that very heavy accidents can be avoided. In that position of the unit an exactly horizontal movement of the cap is no longer required but such movement can be ensured if the auxiliary link 19 consists of a cylinder-piston unit—so that the height of the unit in transit can be minimized.

We claim:

1. A shield-carrying roof support unit which comprises a base frame, a shield, which is linked to the base frame, a cap, which is pivoted to the shield, and at least one prop, which acts between the base frame, on the one hand, and the shield or cap, on the other hand, wherein the shield is connected to the base frame by two links or two pairs of links, which are spaced different distances apart from the rear end of the shield-carrying roof support unit, the pivotal connections between the links or pairs of links and the base frame are approximately on the same of level the rear link or pair of links is or are shorter than the forward link or pair of links, the distance between the pivotal connections between the links or pairs of links and the shield is smaller than the distance between the pivotal connections between the links or pairs of links and the base frame, and the lengths of the links or pairs of links and the distances between the pivotal connections thereof are selected so that the pivotal connection between the cap and the shield is constrained to move approximately at right angles to the base frame, characterized in that the prop or props engages or engage the shield or cap close to the pivotal connection between the cap and the shield, the cap is provided with at least one depending arm near the pivotal connection between the cap and the shield, at least one auxiliary link is pivoted to the free end of said arm (pivotal connection), and said auxiliary link is pivoted at its other end (pivotal connection) to one of the links or pairs of links which connects or connect the shield to the base frame.

2. A shield-carrying roof support unit according to claim 1, characterized in that the other end of the auxiliary link is pivoted to the forward link or pair of links.

3. A shield-carrying roof support unit according to claim 1 or 2, characterized in that the auxiliary link consists of a hydraulic actuator.

4. A shield-carrying roof support unit according to claim 1 or 2, characterized in that the distance from the pivotal connection between the auxiliary link and the depending arm to the pivotal connection between the cap and the shield is approximately as large as the distance from the pivotal connection between the auxiliary link and the forward link or pair of links to the pivotal connection between said forward link or pair of links and the shield.

5. A shield-carrying roof support frame according to claim 1 or 2, characterized in that the cap protrudes in known manner rearwardly beyond the pivotal connection between the cap and the shield.

6. A shield-carrying roof support frame according to claim 1 or 2, characterized in that the prop or props is or are inclined in known manner opposite to the links or pairs of links.

* * * * *